US005857170A

United States Patent [19]

Kondo

[11] Patent Number: 5,857,170

[45] Date of Patent: Jan. 5, 1999

[54] CONTROL OF SPEAKER RECOGNITION CHARACTERISTICS OF A MULTIPLE SPEAKER SPEECH SYNTHESIZER

[75] Inventor: Reishi Kondo, Tokyo, Japan

[73] Assignee: NEC Corporation, Tokyo, Japan

[21] Appl. No.: 515,107

[22] Filed: Aug. 14, 1995

[30] Foreign Application Priority Data

Aug. 18, 1994 [JP] Japan ..... 6-216644

[51] Int. Cl.[6] ..... G10L 5/02; G10L 9/00; G10L 3/00

[52] U.S. Cl. ..... 704/266; 704/275

[58] Field of Search ..... 395/2.75; 704/266, 704/275

[56] References Cited

U.S. PATENT DOCUMENTS

| | | | |
|---|---|---|---|
| 5,029,214 | 7/1991 | Hollander | 381/51 |
| 5,133,010 | 7/1992 | Borth et al. | 381/38 |

FOREIGN PATENT DOCUMENTS

| | | | |
|---|---|---|---|
| 4-175046 | 6/1992 | Japan | 704/258 |
| 4-175049 | 6/1992 | Japan | 704/258 |

OTHER PUBLICATIONS

"Text–to–Speech Conversion System", NEC Research and Development, vol. 35, No. 4, Oct. 1994, pp. 428–430.

Takashi et al, "Speech Synthesizing Software for Personal Computers", The Information Processing Society of Japan, 47th National Convention, vol. 2, pp. 377–378.

Stifelman et al, Voice Notes: A Speech Interface for a Hand–held Voice Notetaker, ACM, Apr. 24, 1993.

*Primary Examiner*—David R. Hudspeth
*Assistant Examiner*—Robert Louis Sax
*Attorney, Agent, or Firm*—Laff, Whitesel, Conte & Saret, Ltd.

[57] ABSTRACT

A speech synthesizing apparatus for varying a speech characteristic condition is adapted to accept a speech request that does not have a speech characteristic condition and to synthesize a speech responsive thereto. A controlling portion accepts a plurality of speech requests; a speech synthesizing portion switches a plurality of speech characteristics for speech synthesis; a speaker outputs a speech corresponding to an output signal of the speech synthesizing portion; and a synthesizer characteristic table stores speech characteristic conditions synthesized by the speech synthesizing portion. The controlling portion can accept a speech request that does not have a speech characteristic condition. Then, the controlling portion selects an available speech characteristic condition from a synthesizer characteristic table and sends the selected speech characteristic condition to the speech synthesizer. While requirements of each speech request are satisfied, the user can be prevented from confusing the synthesized speech with other speech.

12 Claims, 17 Drawing Sheets

FIG.2

43

| ITEM NUMBER i | ITEM NAME | CONTENTS |
|---|---|---|
| 1 | SPEAKER NUMBER | MALE SPEECH: 1, 2, 3<br>FEMALE SPEECH: 4, 5, 6 |
| 2 | AGE | 5, 10, 15, 17, 24, 32, 50 |
| 3 | AVERAGE PITCH FREQUENCY | 50Hz, 70Hz, 90Hz, 100Hz, 150Hz, 200Hz |
| 4 | ACCENT STRENGTH | STRONG, MEDIUM, WEAK |
| 5 | SPEECH SPEED | FAST, MEDIUM, SLOW |

FIG. 3

| ITEM NUMBER i | ITEM NAME | REQUESTED SPEECH CHARACTERISTIC CONDITION | REALIZED CONDITION |
|---|---|---|---|
| 1 | SPEAKER NUMBER | ANY MALE FOR SPEAKER | 3 |
| 2 | AGE | ANY | 17 |
| 3 | AVERAGE PITCH FREQUENCY | 70Hz | 70Hz |
| 4 | ACCENT STRENGTH | MEDIUM | MEDIUM |
| 5 | SPEECH SPEED | ANY | SLOW |

FIG.6

45

| ITEM NUMBER i | 1 | 2 | 3 | 4 | 5 |
|---|---|---|---|---|---|
| ITEM NAME | SPEAKER NUMBER | AGE | AVERAGE PITCH FREQUENCY | ACCENT STRENGTH | SPEECH SPEED |
| ID=1 | 3 | 17 | 70Hz | MEDIUM | SLOW |
| ID=2 | 1 | 50 | 70Hz | WEAK | SLOW |
| ID=5 | 6 | 24 | 150Hz | STRONG | FAST |
| ID=8 | 3 | 5 | 200Hz | MEDIUM | MEDIUM |
| ID=12 | 5 | 10 | 100Hz | WEAK | SLOW |

FIG.7

| ITEM NUMBER i | ITEM NAME | REQUESTED SPEECH CHARACTERISTIC CONDITION |
|---|---|---|
| 1 | SPEAKER NUMBER | 3 |
| 2 | AGE | 17 |
| 3 | AVERAGE PITCH FREQUENCY | 70Hz |
| 4 | ACCENT STRENGTH | MEDIUM |
| 5 | SPEECH SPEED | SLOW |

FIG.8

| ITEM NUMBER i | ITEM NAME | REQUESTED SPEECH CHARACTERISTIC CONDITION |
|---|---|---|
| 1 | SPEAKER NUMBER | 5 |
| 2 | AGE | 32 |
| 3 | AVERAGE PITCH FREQUENCY | ANY |
| 4 | ACCENT STRENGTH | ANY |
| 5 | SPEECH SPEED | FAST |

FIG.9

(a) DIFFERENCE BETWEEN EACH SPEAKER

| | SPEAKER 1 | SPEAKER 2 | SPEAKER 3 | SPEAKER 4 | SPEAKER 5 | SPEAKER 6 |
|---|---|---|---|---|---|---|
| SPEAKER 1 | 0.0 | 1.5 | 2.3 | 5.5 | 8.4 | 7.6 |
| SPEAKER 2 | 1.5 | 0.0 | 0.8 | 12.0 | 6.1 | 9.4 |
| SPEAKER 3 | 2.3 | 0.8 | 0.0 | 8.2 | 6.0 | 4.3 |
| SPEAKER 4 | 4.3 | 6.0 | 8.2 | 0.0 | 0.8 | 1.4 |
| SPEAKER 5 | 9.4 | 6.1 | 12.0 | 0.8 | 0.0 | 2.1 |
| SPEAKER 6 | 7.6 | 8.4 | 5.5 | 1.4 | 2.1 | 0.0 |

(b) DIFFERENCE BETWEEN EACH ACCENT STRENGTH

| | STRONG | MEDIUM | WEAK |
|---|---|---|---|
| STRONG | 0.0 | 1.0 | 2.0 |
| MEDIUM | 1.0 | 0.0 | 1.0 |
| WEAK | 2.0 | 1.0 | 0.0 |

(c) DIFFERENCE BETWEEN EACH SPEECH SPEED

| | FAST | MEDIUM | SLOW |
|---|---|---|---|
| FAST | 0.0 | 1.5 | 3.0 |
| MEDIUM | 1.5 | 0.0 | 1.5 |
| SLOW | 3.0 | 1,5 | 0.0 |

FIG.10

| ID | RECORDED VALUE | VALUE VALID FOR AVERAGE PITCH FREQUENCY V(3) | | | | | |
|---|---|---|---|---|---|---|---|
| | | 50Hz | 70Hz | 90Hz | 100Hz | 150Hz | 200Hz |
| ID=1 | 70Hz | 0.7 | 0.0 | 0.7 | 1.0 | 2.7 | 4.3 |
| ID=2 | 70Hz | 0.7 | 0.0 | 0.7 | 1.0 | 2.7 | 4.3 |
| ID=5 | 150Hz | 3.3 | 2.7 | 2.0 | 1.7 | 0.0 | 1.7 |
| ID=8 | 200Hz | 5.0 | 4.3 | 3.7 | 3.3 | 1.7 | 0.0 |
| ID=12 | 100Hz | 1.7 | 1.0 | 0.3 | 0.0 | 1.7 | 3.3 |
| CUMULATED DIFFERENCE | | 11.4 | 8.0 | 7.4 | 7.0 | 8.8 | 13.6 |

REALIZED VALUE vfix(3) = 200 Hz

FIG.11

| ID | RECORDED VALUE | VALUE VALID FOR ACCENT STRENGTH V(4) | | |
|---|---|---|---|---|
| | | STRONG | MEDIUM | WEAK |
| ID=1 | MEDIUM | 1.0 | 0.0 | 1.0 |
| ID=2 | WEAK | 2.0 | 1.0 | 0.0 |
| ID=5 | STRONG | 0.0 | 1.0 | 2.0 |
| ID=8 | MEDIUM | 1.0 | 0.0 | 1.0 |
| ID=12 | WEAK | 2.0 | 1.0 | 0.0 |
| CUMULATED DIFFERENCE | | 6.0 | 3.0 | 4.0 |

REALIZED VALUE vfix (4) = "STRONG"

FIG.12

| ITEM NUMBER i | 1 | 2 | 3 | 4 | 5 |
|---|---|---|---|---|---|
| ITEM NAME | SPEAKER NUMBER | AGE | AVERAGE PITCH FREQUENCY | ACCENT STRENGTH | SPEECH SPEED |
| ID=1 | 3 | 17 | 70Hz | MEDIUM | SLOW |
| ID=2 | 1 | 50 | 70Hz | WEAK | SLOW |
| ID 3 | 5 | 32 | 200Hz | STRONG | FAST |
| ID=5 | 6 | 24 | 150Hz | STRONG | FAST |
| ID=8 | 3 | 5 | 200Hz | MEDIUM | MEDIUM |
| ID=12 | 5 | 10 | 100Hz | WEAK | SLOW |

FIG.15

| ITEM NUMBER i | 1 | 2 | 3 | 4 | 5 | CUMULATED DIFFERENCE |
|---|---|---|---|---|---|---|
| ITEM NAME | SPEAKER NUMBER | AGE | AVERAGE PITCH FREQUENCY | ACCENT STRENGTH | SPEECH SPEED | |
| REQUIRED SPEECH CONDITION | 5 | 32 | ANY | ANY | FAST | — |
| REALIZED VALUE | 5 | 32 | 200Hz | STRONG | FAST | — |
| ID=1 | 12.0 | 4.5 | 4.3 | 1.0 | 3.0 | 24.8 |
| ID=2 | 9.4 | 6.5 | 4.3 | 2.0 | 3.0 | 25.2 |
| ID=5 | 2.1 | 1.3 | 1.7 | 0.0 | 0.0 | 5.1 ← Dmin |
| ID=8 | 12.0 | 14.6 | 0.0 | 1.0 | 1.5 | 29.1 |
| ID=12 | 0.0 | 9.7 | 3.3 | 2.0 | 3.0 | 18.0 |

CONTROL OF SPEAKER RECOGNITION CHARACTERISTICS OF A MULTIPLE SPEAKER SPEECH SYNTHESIZER

BACKGROUND OF THE INVENTION

1. Field of the Invention

The present invention relates to a speech synthesizing apparatus and to a method for accepting a plurality of speech characteristic condition designating requests, and in particular, to a speech synthesizing apparatus for issuing speech requests without a need to designate all or part of conditions.

2. Description of the Related Art

Speech synthesizing apparatuses that synthesize speeches with a plurality of speech characteristics corresponding to speech characteristic parameters are known (as in Japanese Patent Laid-open Publication No.4-175046 and No.4-175049). The term speech characteristics is a general term of characteristics that depend on sex, age, individual, speech tone (average pitch frequency), pitch change amount, speech speed, accent strength, and so forth.

In addition, a speech synthesizing apparatus that accepts a plurality of speech characteristic condition designating requests and that operates in a multi-task environment or a network environment is disclosed in a technical paper by Takahashi et. al. entitled "Speech Synthesizing Software for Personal Computers", The Information Processing Society of Japan, 47-th National Convention, Vol. 2, pp. 377–378).

In the conventional speech synthesizing apparatuses, the user who issues a speech request should designate all speech characteristic conditions.

However, depending on an objective of speech synthesis, it is not necessary to strictly designate all speech characteristic conditions. For example, when a newspaper article is vocally synthesized, the speech speed of the speech characteristic conditions is important. However, other speech characteristic conditions (for example, sex and age) may not be important. In the conventional apparatuses, in such a case, all speech characteristic conditions should be individually designated.

Moreover, in the conventional speech synthesizing apparatus for accepting a plurality of speech characteristic conditions, when a plurality of speech requests are accepted, the apparatus does not determine whether or not the speech characteristic conditions of each speech request are similar to each other. Thus, the speech characteristics of several speech requests may be aurally the same or similar to each other. In this case, the user cannot identify these speech requests, thereby confusing them. For example, in a personal computer system that has a plurality of printers, when a speech "Out of Paper !" is synthesized from one printer, even if different speech characteristics are designated to each printer, the user cannot identify the printer that is "out of paper".

SUMMARY OF THE INVENTION

The present invention is made from the above-described point of view.

A first object of the present invention is to provide a speech synthesizing apparatus for accepting a speech request without a need to designate all speech characteristic conditions.

A second object of the present invention is to provide a speech synthesizing apparatus for automatically designating speech characteristic conditions to a plurality of unknown speech requests so as to prevent the user from confusing them.

A first aspect of the present invention is a speech synthesizing apparatus, comprising a speech synthesizing portion for synthesizing speeches with different speech characteristics; including normal speech characteristics. The synthesizer characteristic storing portion stores characteristic conditions of speeches synthesized by the speech synthesizing portion. A controlling portion provides for accepting a speech request composed of a plurality of speech characteristic items, accepting a speech request that has an item without a speech characteristic, designating a speech characteristic condition to the item with reference to the speech characteristic conditions stored in the synthesizer characteristic storing portion corresponding to a predetermined method, and issuing a command representing the designated speech characteristic to the speech synthesizing portion.

A second aspect of the present invention is the speech synthesizing apparatus of the first aspect of the present invention, further comprising a speech characteristic recording portion for recording a speech synthesizing situation for each speech request. The speech characteristic difference calculating portion is for calculating the difference between the value of the item without the condition of the speech request and the value of the corresponding item of each of speech request recorded in the speech characteristic recording portion. The controlling portion designates the value of the item without the condition so that the difference obtained by the speech characteristic calculating portion becomes large.

According to the first aspect of the present invention, when a speech request that does not have a speech characteristic condition is accepted, the controlling portion designates a speech characteristic condition with reference to the speech characteristic conditions stored in the synthesizer characteristics storing portion.

According to the second aspect of the present invention, the speech characteristic difference calculating portion calculates the speech characteristic difference. The speech characteristic condition is designated so that the speech characteristic difference becomes large. Thus, even if a plurality of speech requests are accepted, they can be synthesized so that the user does not confuse them.

These and other objects, features and advantages of the present invention will become more apparent in light of the following detailed description of best mode embodiments thereof, as illustrated in the accompanying drawings.

BRIEF DESCRIPTION OF DRAWINGS

FIG. 2 is a list showing the contents of a synthesizer characteristic table according to the embodiment shown in FIG. 1;

FIG. 3 is a list showing speech requests used in the embodiment shown in FIG. 1 and realized values of selected speech characteristic conditions;

FIG. 6 is a list showing the contents of a speech characteristic recording table 45 according to the second embodiment;

FIG. 7 is a list showing a speech request (ID=1) that does not have a "any value" item according to the second embodiment;

FIG. 8 is a list showing a speech request (ID=3) that does not have an entry of the speech characteristic recording table 45 according to the second embodiment;

FIG. 9 show tables for designating (a) speaker number difference, (b) accent strength difference, and (c) speech difference according to the second embodiment;

FIG. 10 is a list for explaining the method for obtaining a realized value vfix(3) of an average pitch frequency that is an "any value" item of a speech request (ID=3) according to the second embodiment;

FIG. 11 is a list for explaining the method for obtaining a realized value vfix(4) of an accent strength that is an "any value" item of the speech request (ID=3) according to the second embodiment;

FIG. 12 is a speech characteristic recording table 45 for recording a new speech request (ID=3) according to the second embodiment;

FIG. 15 is a cumulated difference recording table 42 according to the third embodiment;

DESCRIPTION OF PREFERRED EMBODIMENTS

First Embodiment

Figure 1:
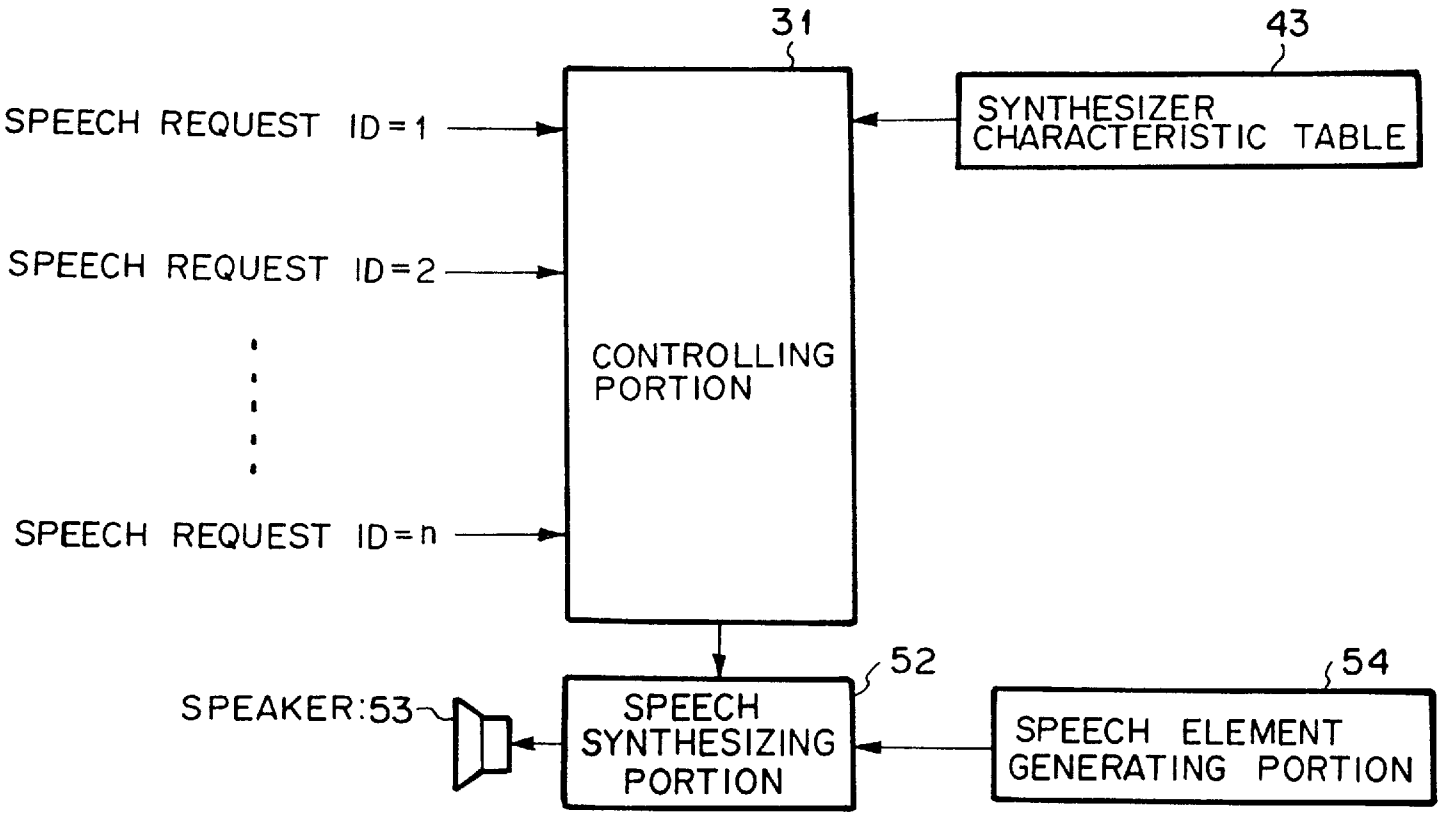
FIG. 1 is a block diagram showing a speech synthesizing apparatus according to a first embodiment of the present invention.

FIG. 1 shows the construction of a speech synthesizing apparatus according to a first embodiment of the present invention. The speech synthesizing apparatus of this embodiment comprises a controlling portion 31, a speech element generating portion 54, a speech synthesizing portion 52, a speaker device 53, and a synthesizer characteristic table 43. The controlling portion 31 accepts a plurality of speech requests ID=1, 2, . . . , and n. The speech synthesizing portion 52 synthesizes speeches using speech elements received from the speech element generating portion 54 according to the speech request. The speaker device 53 generates the sound of a speech corresponding to the output signal of the speech synthesizing portion 52.

The speech element generating portion 54 generates a phoneme including a vowel and a consonant or syllables and words or generates a phoneme synthesized according to the speech request. The synthesizer characteristic table 43 functions as a synthesizer characteristic storing portion that stores speech characteristic conditions of speeches synthesized by the speech synthesizing portion 52. The controlling portion 31 is composed of, for example, a CPU. The synthesizer characteristic table 43 is composed of a ROM or the like.

FIG. 2 shows the contents of the synthesizer characteristic table 43. In other words, as shown in FIG. 2, the characteristics of speech synthesized by the speech synthesizing portion 52 can be selected from among six speakers of three male speakers and three female speakers (1 to 3 and 4 to 6), seven ages (age 5 to age 50), six average pitch frequencies (50 Hz to 200 Hz), three accent strengths (strong, medium, weak), and three speech speeds (fast,medium,slow).

Next, in an example where a speech request (ID=1) shown in FIG. 3 is issued, the operation of the embodiment will be described. In the speech request shown in FIG. 3, the speaker number (item 1), the age (item 2), the speech speed (item 5) are "any", not specific, including normal speech characteristics. (Hereinafter, these unspecified items are referred to as "any value" items).

The controlling portion 31 selects values for the "any value" items from the synthesizer characteristic table 43, one by one, and designates these values as realized conditions of the table shown in FIG. 3. The controlling portion 31 sends the realized conditions to the speech synthesizing portion 52. Thus, the speech synthesizing portion 52 synthesizes the speech elements of the speech element generating portion 54 according to the realized conditions and outputs a synthesized speech. The synthesized speech is output from the speaker 53.

Alternatively, values may be randomly selected from the synthesizer characteristic table 43. As another alternative method, a predetermined rule may be stored in the controlling portion 31. Values may be selected from the synthesizer characteristic table 43 corresponding to the predetermined rule. As a predetermined rule, when the speaker number (item 1) and the average pitch frequency (item 3) are "any value" items, a high pitch may be selected for a female speaker. In addition, values may be selected from the synthesizer characteristic table 43 corresponding to an experientially obtained rule. For example, requested speech characteristic conditions for each "any value" item that has been selected the last time may be counted up. A condition with the next higher count number may be selected as a realized condition.

A speech characteristic condition designating request may be issued only if the condition before several speech commands representing a chain of a speech text is issued. Alternatively, a speech characteristic condition designating request may be issued after adding the condition along with a speech command.

Thus, since items that are not important are "any value" items, speech request conditions can be easily and quickly designated.

Second Embodiment

Figure 4:
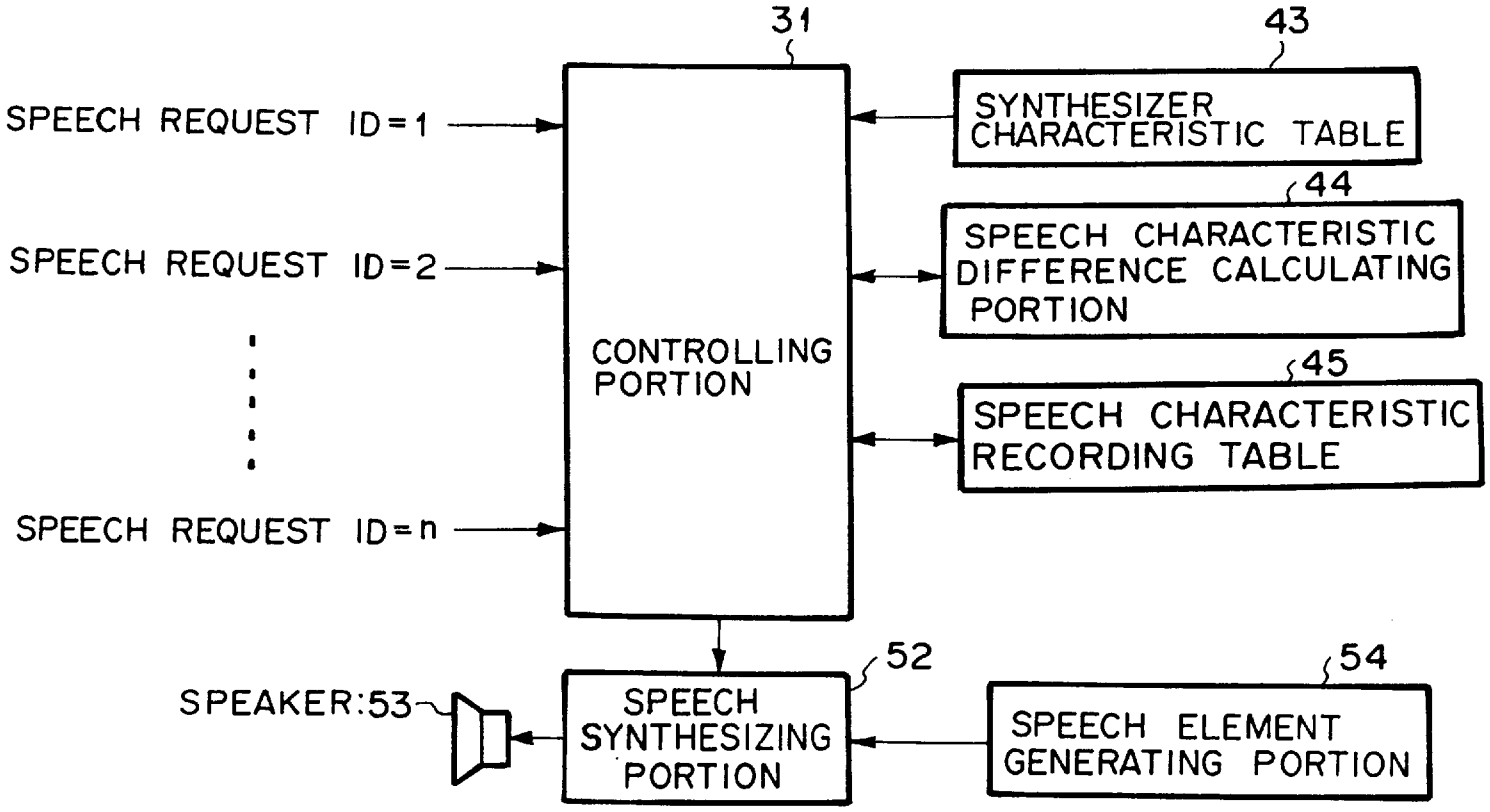
FIG. 4 is a block diagram showing a speech synthesizing apparatus according to a second embodiment of the present invention.

FIG. 4 shows the construction of a speech synthesizing apparatus according to a second embodiment of the present invention. For simplicity, in FIG. 4, portions similar to those of the first embodiment are denoted by similar reference numerals thereof and their detailed description is omitted. In the second embodiment, the speech synthesizing apparatus further comprises a speech characteristic difference calculating portion 44 and a speech characteristic recording table 45. The speech characteristic recording table 45 functions as a speech characteristic recording portion.

The speech characteristic recording table 45 records speech characteristic conditions for each speech request. The speech characteristic recording table 45 is composed of, for example, a RAM. As will be described later, the speech characteristic difference calculating portion 44 calculates the difference between the value of each "any value" item of the speech characteristics of a speech request to be issued and the value of the corresponding item recorded on the speech characteristic recording table 45 in the speech characteristic of speech requests.

Next, with reference to FIG. 5, the operation of the second embodiment will be described. When a speech request (ID=1) is input (at step F1), it is determined whether or not the speech request has been recorded on the speech characteristic recording table 45 (at step F2). Now, it is assumed that the contents of the speech characteristic recording table 45 are as shown in FIG. 6 and the speech request (ID=1) is as shown in FIG. 3. In this case, since the speech request has been recorded in the speech characteristic recording table 45 (see FIG. 5), the determined result at step F2 is YES. Thus, the flow advances to step F3. At step F3, it is determined whether or not the speech request is inconsistent with the speed recording table 45 (at step F3). In this example, since the speaker number (item 1), the age (item 2), and the speech speed (item 3) of the speech request ID=1 are "any value" items (see FIG. 3).

On the other hand, the corresponding items of the speech request (ID=1) of the speech characteristic recording table 45 are "3", "17", and "slow", respectively. Thus, since no consistence takes place, the determined result at step F3 is NO. Consequently, the flow advances to step F4. At step F4, the controlling portion 31 sends the contents (corresponding to ID=1) of the recording table 45 to the speech synthesizing portion 52. The speech synthesizing portion 52 synthesizes a speech from the speech element generating portion 54 corresponding to the speech request (at step F5).

Even if the speech characteristic items of a speech request do not include "any value" items, as long as they are consistent with the corresponding items of the speech characteristic recording table 45, the same operation (from step F1 to F5) is performed. For example, when a speech request (ID=1) as shown in FIG. 7 is input, although it does not include "any value" items, since speech characteristic items of the speech request are consistent with the corresponding items of the speech characteristic recording table 45, a speech corresponding to the conditions of the speech characteristic recording table 45 is synthesized.

Next, the operation in the case that a speech request is not recorded in the speech characteristic recording table 45 will be described. For example, when a speech request (ID=3) (items 3 and 4 are "any value" items) shown in FIG. 8 is input, the contents of the "any value" items are designated (at step F6). At this point, the values of these items are designated so that they do not match the corresponding values of other speech requests recorded in the recording table 45. This operation is performed in the following manner.

The speech characteristic difference calculating portion 44 calculates the difference between each of all values available in the speech synthesizing portion 52 for each of the "any value" items of the input speech request with reference to the synthesizer characteristic table 43 (see FIG. 2) and the value of the corresponding item of the speech characteristic request stored in the speech characteristic recording table 45.

At this point, the difference for each of the speaker number (item 1), the accent strength (item 4), and the speech speed (item 5) can be experientially designated in a range so that the user can aurally identify the difference as shown in the tables (a), (b), and (c) of FIG. 9. An equation and function is assigned according to the aural characteristic.

For the age (item 2), the difference can be obtained according to the following equation (1).

$$d_2(O_1, O_2)=(O_1-O_2)^2/50 \quad (1)$$

where $O_1$ and $O_2$ are an age (in years); $d_2$ is the difference between $O_1$ and $O_2$.

For the average pitch frequency (item 3), the difference is obtained corresponding to the following equation (2).

$$d_3(p_1, p_2)=|p_1-p_2|/30 \quad (2)$$

where $p_1$ and $p_2$ are average pitch frequencies (in Hz); and $d_3$ is the difference between the average pitch frequencies $p_1$ and $p_2$. These equations are experientially obtained on a basis so that the difference can be aurally recognized.

Of course, the speech characteristic difference calculating portion 44 performs a table look-up process for all items corresponding to the characteristics and process amount of the speech synthesizing portion 52. Alternatively, the speech characteristic difference calculating portion 44 may be composed of only an evaluating function. In particular, when the number of characteristics of speeches synthesized by the speech synthesizing portion 52 is small, the table look-up process is effective.

Returning to the example shown in FIG. 8, it is assumed that the average pitch frequency and the accent strength are "any value" items. Corresponding to the equation (2) and the table of FIG. 9(*b*), the differences for the average pitch frequency and the accent strength are obtained. The results are shown in FIGS. 10 and 11. It is assumed that a value valid for an item i is denoted by v(i). In FIG. 10, the difference between each of the value v(3) valid for the average pitch frequency (item 3) in the speech synthesizing portion 52 and the recorded value of the average pitch frequency of each of the speech requests is obtained. For each value v(3), the differences are cumulated(see the last row or line "cumulated difference" of the table of FIG. 10). The pitch frequency with the largest cumulated difference (namely, 200 Hz) is designated as a realized value vfix. In other words, as shown in FIG. 10, the realized value vfix(3) is 200 Hz.

Likewise, for the accent strength (item 4) of FIG. 11, the accent strength with the largest cumulated difference (namely, "strong") is designated as a realized value vfix. In FIG. 11, the realized value vfix(4) is "strong".

After the values of the "any value" items have been designated, the speech characteristic recording table 45 is updated (at step F7). The values of the speech characteristic recording table 45 are sent to the speech synthesizing portion 52 (at step F4). The speech synthesizing portion 52 synthesizes a speech corresponding to the resultant values (at step F5). Thus, the speech request (ID=3) has been added to the speech characteristic recording table and the values of the "any value" items have been designated as shown in FIG. 12.

The designating method of the "any value" items at step F6 (FIG. 5) will be described once again. When a speech request has an "any value" item, the controlling portion 31 selects a realized value Vfix that maximally prevents the user from confusing corresponding to the following equation (3) and sends the realized value Vfix to the speech synthesizing portion 52. The speech synthesizing portion 52 outputs the synthesized speech from the speaker 53.

$$Vfix=[vfix(1), vfix(2), vfix(3), \ldots, vfix(n)] \quad (3)$$

where vfix(i) is a realized value of each item; and n is an item number.

Vfix is selected in the following manner. When a condition item i of a speech request is an "any value" item, the speech characteristic difference calculating portion 44 obtains the cumulated value of the difference between the value v(i) valid in the synthesizer characteristic table 43 and the recorded value of each of the speech requests and treats the maximum value as the realized value vfix(i) (see FIGS. 10 and 11). When the value of an item has been designated, the closest value is selected from the synthesizer characteristic table 43 and the selected value is treated as the realized value vfix(i) for the item i.

Thus, according to the second embodiment, a speech characteristic condition can be designated to satisfy an "any value" item. For the "any value" item, a value that is the furtherest from the values of other speech requests is selected from the speech characteristic recording table 45. Thus, a speech that is not confused with other speeches can be synthesized. In addition, since the speech characteristic recording table 45 is used, the same speech characteristics are obtained when the speech request is the same and the speech characteristic condition is the same.

Figure 13:
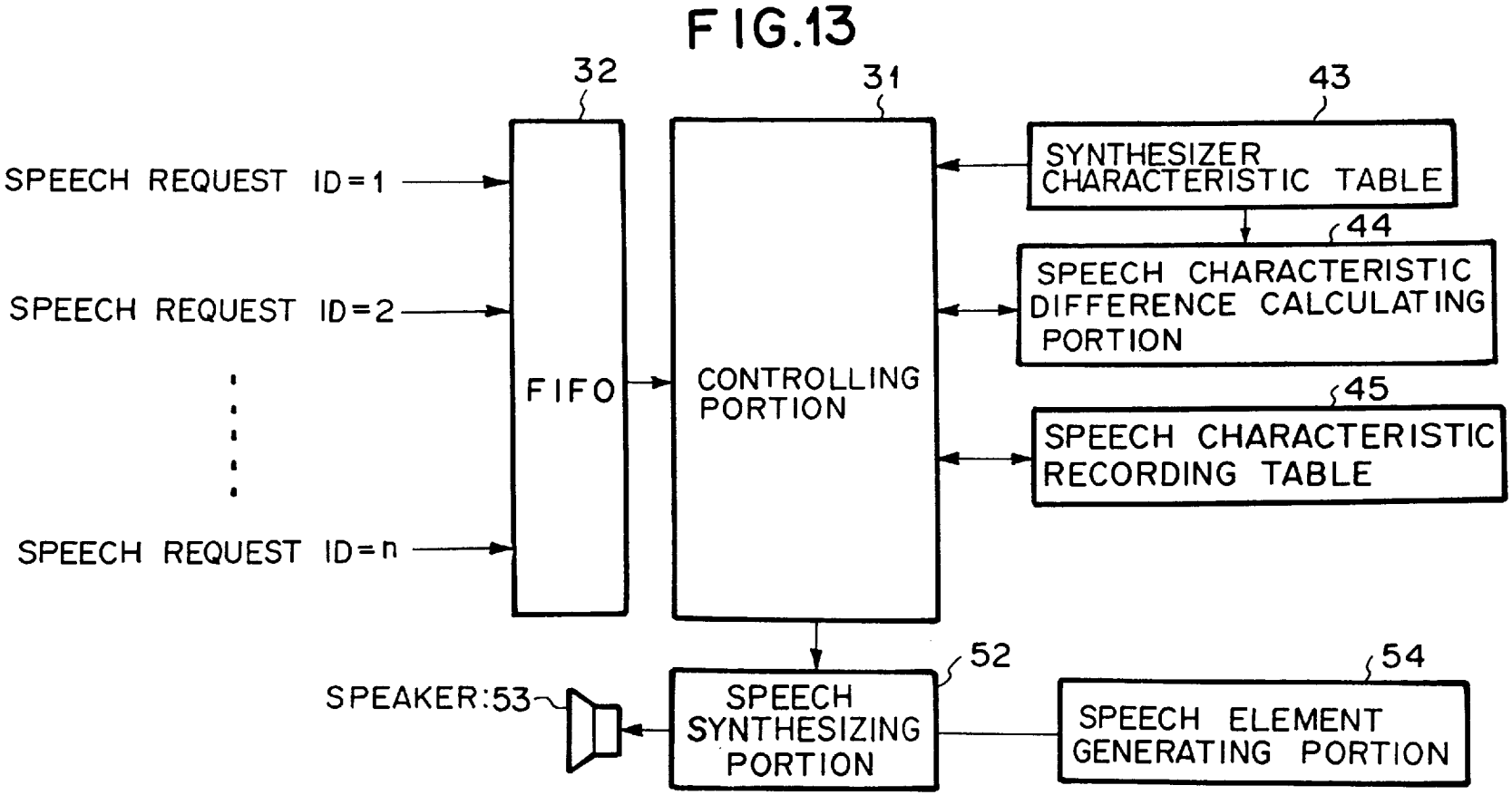
FIG. 13 is a block diagram showing a construction of an input portion having a FIFO memory according to the second embodiment.

As shown in FIG. 13, a FIFO memory 32 may be disposed before the controlling portion 31. The FIFO memory 32 temporarily stores a speech request. The controlling portion 31 can obtain the next speech request from the FIFO memory 32 whenever the operation is completed for one speech request. Thus, even if the speech synthesizer 52 or the controlling portion 31 cannot operate against a plurality of speech requests that take place at the same time, it can successively process them correctly. In this case, when a speech request is sent to the FIFO memory 32 or a precedence process for the request is performed, a speech request with high precedence or a request content with high precedence can be sent to the controlling portion 31 over other speech requests.

Third Embodiment

Figure 14:
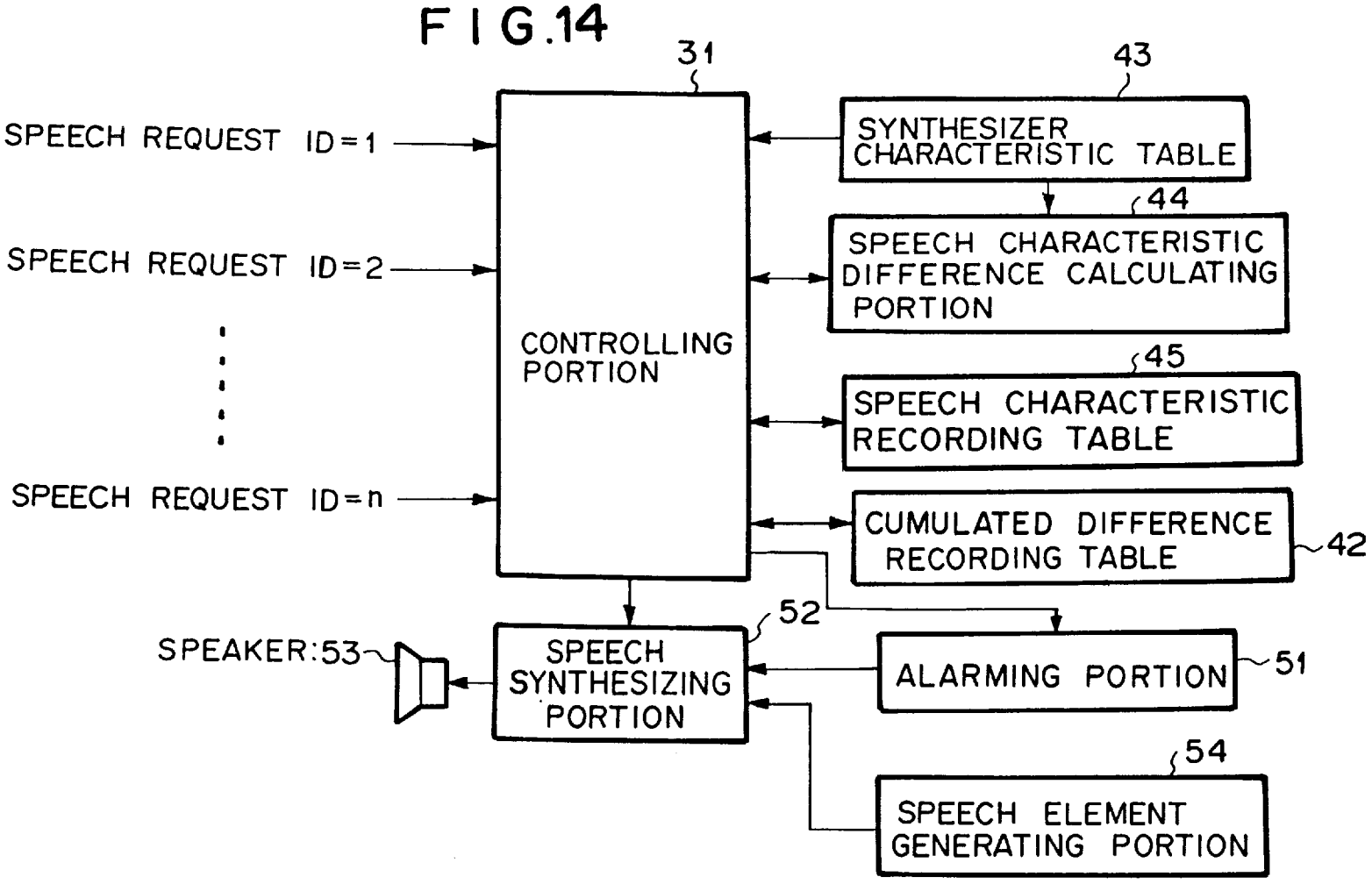
FIG. 14 is a block diagram showing a speech synthesizing apparatus according to a third embodiment of the present invention.

FIG. 14 shows a third embodiment of the present invention. In the third embodiment, a cumulated difference recording table 42 and an alarm portion 51 are added to the construction of the second embodiment shown in FIG. 4. FIG. 15 is an example of the cumulated difference recording table 42.

Figure 5:
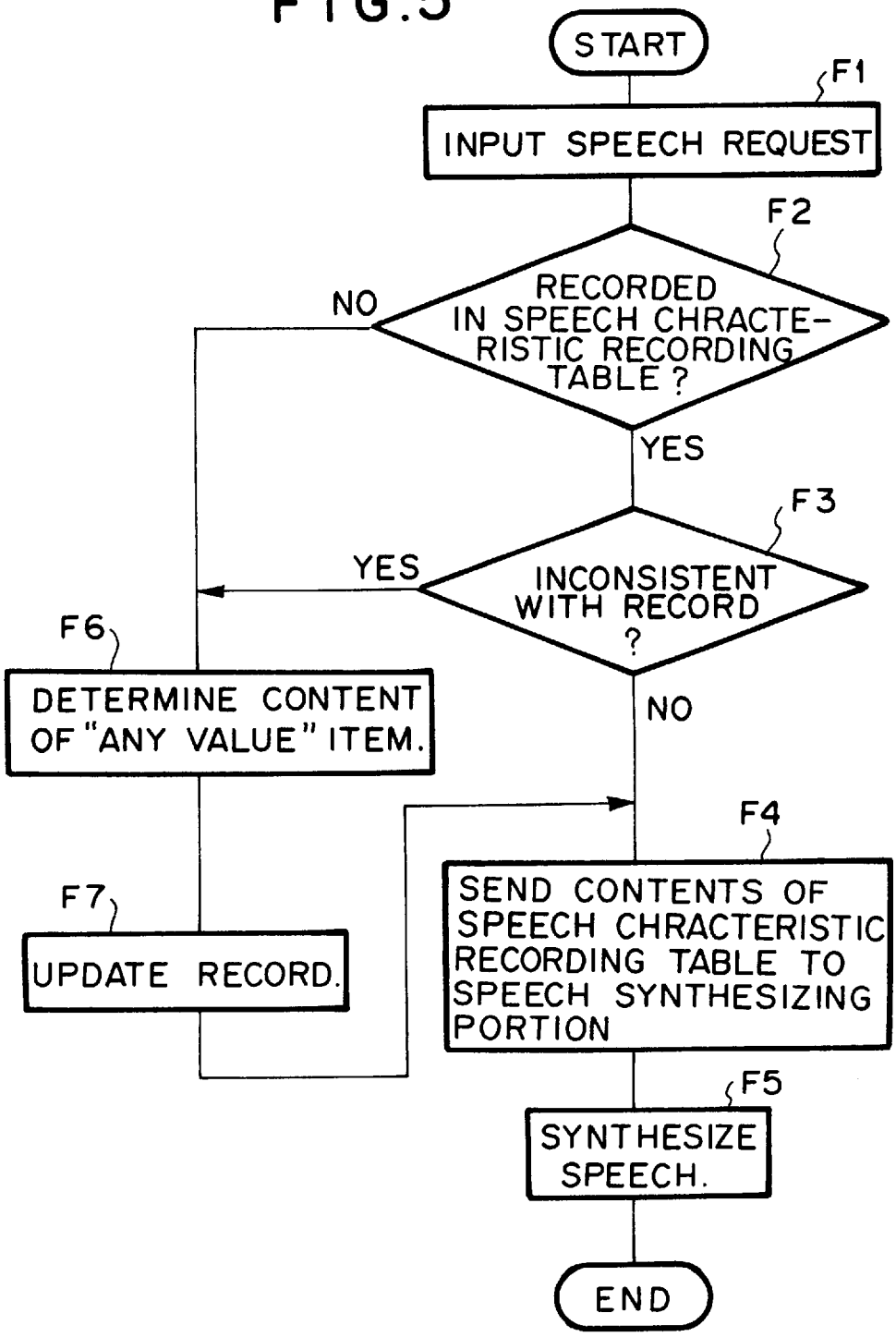
FIG. 5 is a flow chart for explaining the operation of the second embodiment.

The operation of this embodiment is basically the same as that represented by the flow chart of FIG. 5. The controlling portion 31 designates the value of an "any value" item at step F6. Thereafter, the controlling portion 31 obtains the cumulated value of the difference between the realized value of each item designated and the value of each of the speech requests recorded the speech characteristic recording table 45. The cumulated values for the speech requests are recorded in the cumulated difference recording table 42 (the right most column "cumulated difference" of FIG. 15).

The controlling portion 31 obtains a minimum cumulated difference Dmin from the cumulated difference values corresponding to the following equation (4).

$$\mathrm{Dmin}=\min(P)\ \epsilon D_i[\mathrm{vfix}(i), w_p(i)] \tag{4}$$

where $D_i[*.*]$ is the difference between items calculated by the speech characteristic difference calculating portion 44; $w_p(i)$ is the value of the item i of the speech request ID=p recorded in the speech characteristic recording table 45; $\epsilon D_i$ is the sum (cumulated difference) from i=1 to n for the item i; and min(P) is the minimum value of the cumulated difference $\epsilon D_i$ for each speech request ID=p. In FIG. 15, the cumulated difference "5. 1" is the minimum cumulated difference Dmin.

The minimum cumulated difference Dmin is the difference between a speech that will be synthesized by the speech synthesizing apparatus and a speech that is the closest thereto and that has been synthesized and recorded in the speech characteristic recording table 45. In other words, as the minimum cumulated difference Dmin is small, a speech synthesized by the speech synthesizing apparatus is largely confused with speeches made responsive to other speech requests.

To prevent this problem, the controlling portion 31 compares the minimum cumulated difference Dmin with a predetermined threshold value. When the minimum cumulated difference Dmin is smaller than the threshold value, the alarming portion 51 issues an alarm to the user. Thereafter, the controlling portion 31 sends the speech characteristic conditions to the speech synthesizing portion 52 and the speaker device 53 outputs it. It should be noted that the alarm may be issued by a buzzer or the like. Alternatively, the speech synthesizing portion 52 may be driven so as to synthesize an alarm speech along with a message representing the next speech request.

Since such an alarm is issued, even if the speech that is synthesized is close to another speech, the user can identify the speech without confusing another speech.

To obtain the minimum cumulated difference Dmin, instead of the simple sum expressed by the equation (4), assuming that each item is orthogonal, an Euclidean difference (equation (5)) can be used.

$$\mathrm{Dmin}=\min(P)(\epsilon D_i[\mathrm{vfix}(i), w_p(i)]^2)^{1/2} \tag{5}$$

Fourth Embodiment

Next, a fourth embodiment of the present invention will be described. In the third embodiment, the minimum cumulated difference Dmin is compared with the predetermined threshold value. When the minimum cumulated difference Dmin is smaller than the threshold value, an alarm is issued to the user. However, according to the fourth embodiment, the minimum cumulated difference Dmin is compared with the predetermined threshold value. When the minimum cumulated difference Dmin is larger than the threshold value, speech characteristic conditions are sent to the speech synthesizing portion 52 so synthesize a speech. However, when the minimum cumulated difference Dmin is smaller than the threshold value, no speech is synthesized. A message that represents that a speech was not synthesized is sent to the speech requester. Thus, the speech requester knows that the requested speech characteristic conditions are improper.

In addition, a message indicating that the speech was synthesized can be sent to the speech requester. In this case, the speech requester can know the timing of sending the next speech request to the speech synthesizing apparatus. When the speech cannot be synthesized, although the requested conditions are not satisfied, a message that represents speech characteristic conditions currently available can be issued to the speech requester so as to suggest that the speech characteristic conditions should be changed.

Fifth Embodiment

In the fifth embodiment, speech characteristic conditions, range, restriction conditions, and so forth are designated to the speech synthesizing portion 52. Restriction conditions of the speech synthesizing portion 52 are for example 1) the speaker number 4 must not make speeches of a person of age 20 or over, 2) the range of the average pitch frequency of a male speaker is different from that of a female speaker, 3) since the speaker number 1 is most fit into speeches of a person of age 25, the speaker number 1 should be paired with age 25. These restrictions are recorded in the synthesizer characteristic table 43.

The other portions of this embodiment are the same as those of the second to fourth embodiments.

In the fifth embodiment, instead of obtaining the realized value vfix(i) of each item of Vfix according to the equation (3), all combinations of the requested condition V are considered from the synthesizer characteristic table 43 corresponding to the following equation (6).

$$V=\{v(1), v(2), v(3), \ldots, v(n)\} \quad (6)$$

For the combination V, the cumulated value of the difference between each of the speech requests recorded in the speech characteristic recording table 45 and the corresponding item is obtained by the speech characteristic difference calculating portion 44 corresponding to the following equation (7).

$$d(V)=\min(P)\epsilon D_i[v(i), w_p(i)] \quad (7)$$

where min(P) and $\epsilon D_i$ are the same as those of the equation (4).

The combination V is obtained so that the cumulated difference d(V) becomes maximum. The result is the minimum cumulated difference Dmin (see equation (8)).

$$Dmin=\max(V)d(V) \quad (8)$$

At this point, the combination v is the realized value Vfix (see equation (9)).

$$Vfix=\text{argmax}(V)d(V) \quad (9)$$

According to this method, a low cost speech synthesizing portion 52 that has restrictions of speech characteristic conditions can be used. When values of V are not fully satisfied in the entire orthogonal space (for example, the speaker number 4 does not make speeches of a person of age 20 or over or the range of the average pitch frequency of a male speaker is different from that of a female speaker), such a method can be used. In the above-described example, when parameters are changed, the speaker number 1 can speak speeches of a person of ages 15 to 40. However, when speeches of a person of age 25 are most natural, a restriction of which the speaker number 1 and age 25 are paired is applied to the speech characteristic difference calculating portion 44. Thus, more natural speeches can be synthesized.

Sixth Embodiment

Figure 16:
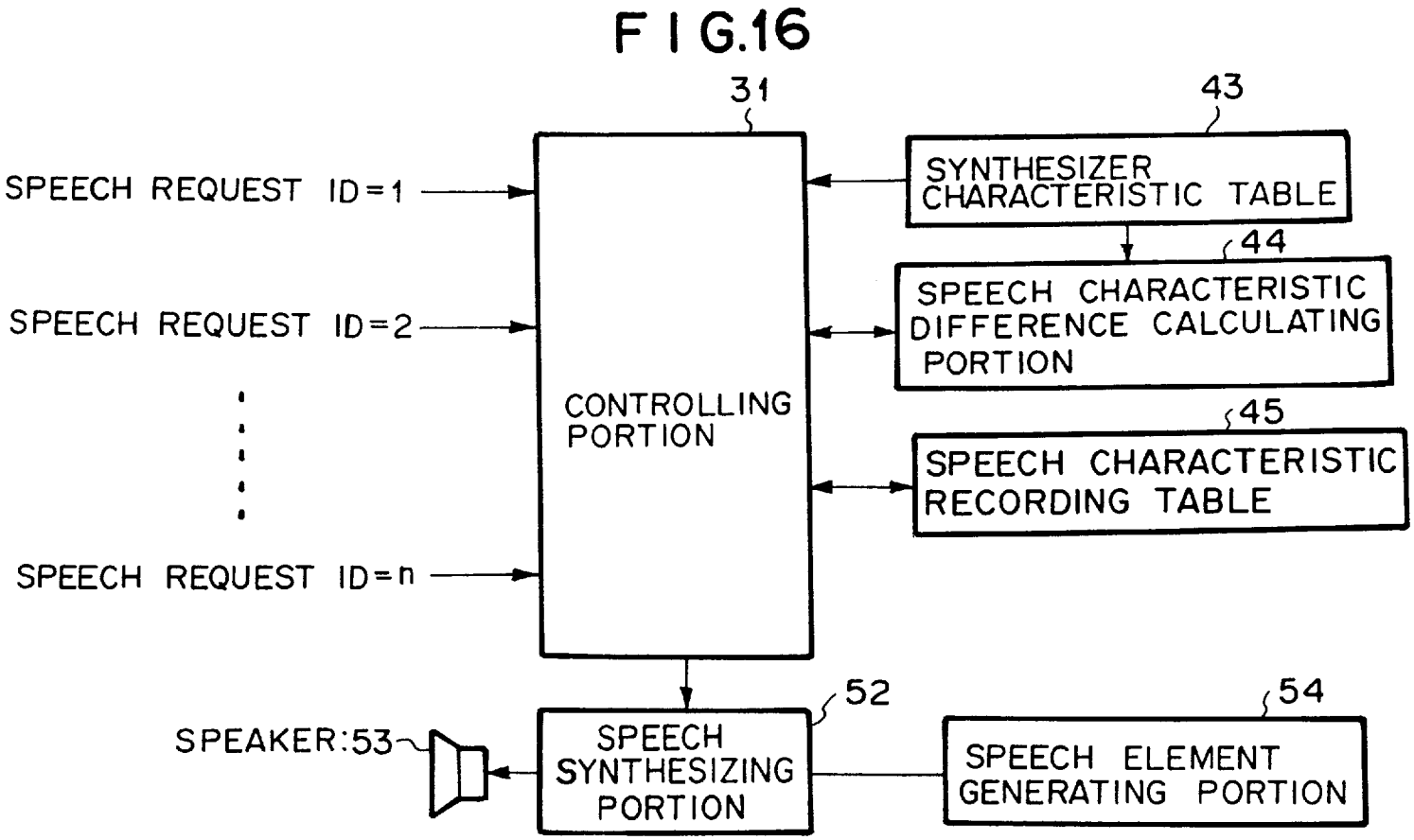
FIG. 16 is a block diagram showing a speech synthesizing apparatus according to a sixth embodiment of the present invention.

FIG. 16 is a block diagram showing a construction of a speech synthesizing apparatus according to a sixth embodiment of the present invention. For simplicity, in FIG. 16, portions similar to those of the above-described embodiments are denoted by similar reference numerals. In the sixth embodiment, the controlling portion 31 selects speech characteristic conditions and sends them to the speech synthesizing portion 52. In addition, the controlling portion 31 sends them to the speech requester. The speech characteristic conditions are outputted to the display, the speaker, and so forth so that the speech requester can know the designated speech characteristic conditions. Thus, the calculating process of the speech synthesizing apparatus can be reduced and the user can change the display contents corresponding to the synthesized speech.

Seventh Embodiment

Figure 17:
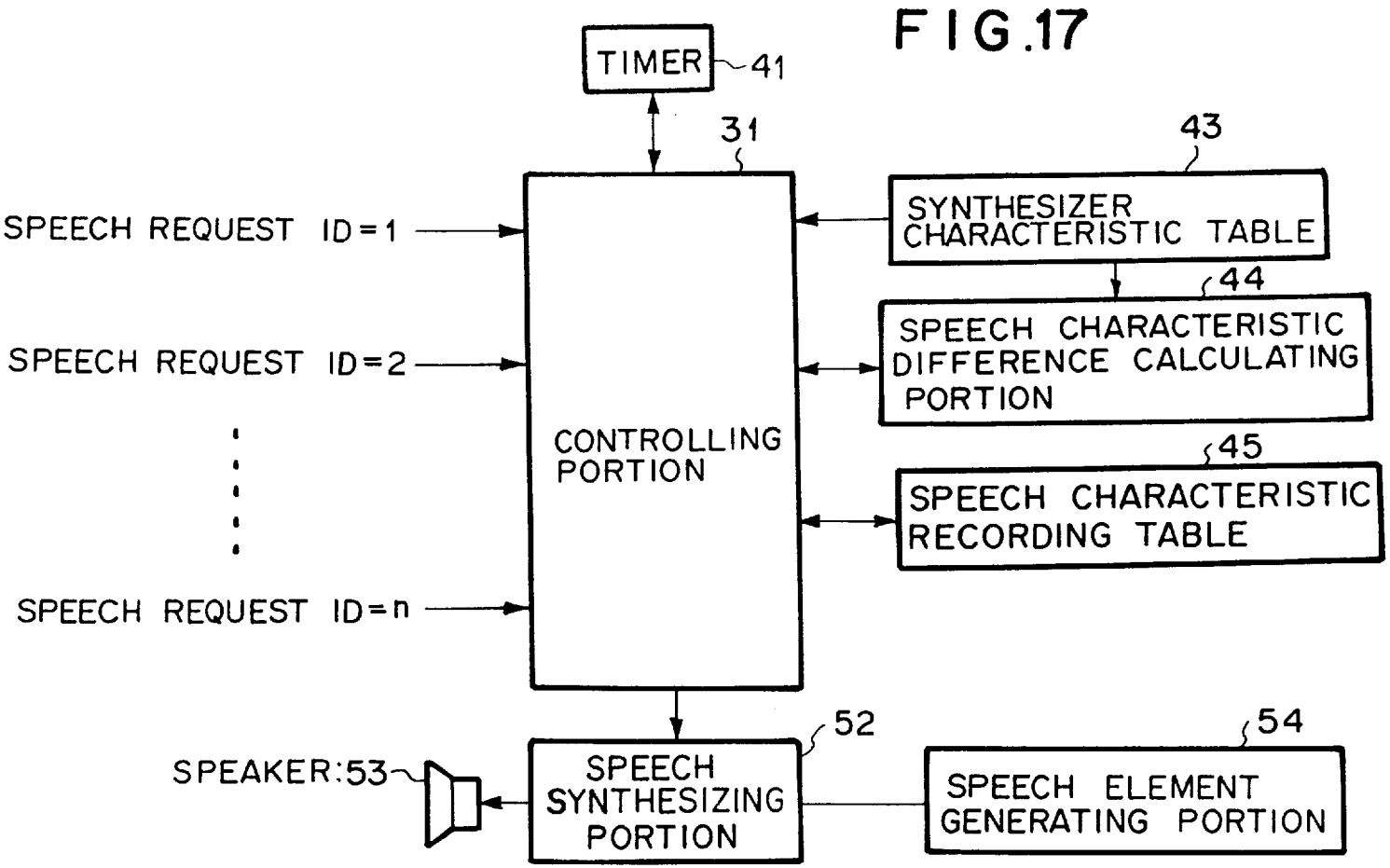
FIG. 17 is a block diagram showing a speech synthesizing apparatus according to a seventh embodiment of the present invention.

FIG. 17 is a block diagram showing a construction of a speech synthesizing apparatus according to a seventh embodiment of the present invention. In the seventh embodiment, a timer 41 is added to the construction of each of the second to sixth embodiment. The timer 41 periodically interrupts the controlling portion 31 so as to cause the controlling portion 31 to discard entries updated before an elapse of a predetermined time period from the speech characteristic recording table 45. Thus, new speech characteristic conditions are not improperly restricted by speech characteristic conditions that have not been often used.

The controlling portion 31 may use another timer for a plurality of designations instead of periodically issuing interrupts. According to a predetermined speech request, the next notification time and notification number are designated. By discarding the entry of the speech request corresponding to the notified number from the speech characteristic recording table 45, the load of the interrupts of the controlling portion 31 can be reduced. It should be noted that in the above-described embodiments, the items of the speech characteristics are speaker number, age, average pitch frequency, accent strength, and speech speed. However, other items can also be added, such as either the huskiness of the voice or a provinced accent.

According to the present invention, in the speech synthesizing apparatus that can synthesize speeches with a plurality of speech characteristics and accepts a plurality of speech characteristic condition designating requests. A particular condition can be designated to an "any value" item without need to designate all conditions to a speech request. In addition, since each speech request is synthesized with the same or similar speech characteristics, the user does not confuse it with other speeches.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A speech synthesizer comprising;

a synthesizing portion for synthesizing speech with different speaker characteristics;

a storing portion for storing tables of speaker characteristics for different synthetic speakers;

a first controller portion (31) for controlling speaker recognition by a full list of default speaker characteristics obtained from a speech characteristic recording table (45);

a second controller portion (31) for dynamically enhancing speaker recognition by changing a partial list of the speaker characteristics recorded on said recording table (45); and a third controller portion (31) for further enhancing speaker recognition by changing the first controller portion of background speaker characteristics prior to changing selected values of the second controller portion of foreground speaker characteristics.

2. A speech synthesizer as set forth in claim 1 further comprising:

a storing portion which records a set of speaker characteristics for each speech synthesis request;

a calculator portion which calculates a speaker difference recognizability parameter and which calculates the difference of synthetic speakers by two calculating means;

first calculating means for calculating a speaker difference recognizability parameter between two synthetic speakers by calculating a speaker difference recognizability parameter dependent on the change of speaker characteristics obtained by applying the third controlling portion; and second calculating means for calculating a larger speaker difference recognizability parameter which is performed by changing the first calculator portion to another state before invoking the first controlling portion of changing the speaker characteristics.

3. A speech synthesizer as set forth in claim 1, further comprising:

calculating means for calculating a value of accumulated speaker difference recognizability parameters which are accumulated in response to said speech requests stored by the speaker characteristic storing portion, wherein a value of "above a threshold" confirms by default that the third controlling portion operation is satisfactory and wherein a value of "below said threshold" confirms that the third controlling portion sends a warning signal.

4. A speech synthesizer as set forth in claim 1, further comprising:

calculating means for calculating a value of accumulated speaker difference recognizability parameters which are accumulated in response to said speech requests stored by a speaker characteristic storing portion, wherein a value of "above a threshold" confirms by default that the third controlling portion operation is satisfactory and wherein a value of "below said threshold" determines that the third controlling portion will not synthesize speech.

5. The speech synthesizing apparatus as set forth in claim 1, further comprising:

means wherein said controlling portion notifies a speech requester whether or not a requested speech characteristic condition has been accepted and notifies the speech requester of the conditions used when the requested speech is to be synthesized.

6. The speech synthesizing apparatus as set forth in claim 2, further comprising:

a timer for measuring a time period of data recorded in said speech characteristic recording portion so as to discard old data.

7. A speech synthesizing apparatus, comprising:

means including a speech synthesizing portion for synthesizing speakers with different speech characteristics;

means including a speaker characteristics storing portion for storing speaker characteristics which are synthesized by said speech synthesizing portion in order to create a speech sound;

means including a speaker characteristics recording portion for recording the speaker characteristics for each of speech request;

means including an aural speaker difference recognizability parameter calculation portion for calculating the difference between a value of an item without the aural speaker characteristics and a value of the corresponding item with each of the speaker characteristics of said speech request recorded in said speaker characteristics recording portion; and means including a controlling portion for accepting a type of speech request composed of a plurality of speaker characteristics, accepting a type of speech request that has an item without a designated speaker difference recognizability parameter; for causing said speaker difference recognizability parameter calculating portion to calculate the speaker difference recognizability parameter between a value of the item without the speaker characteristics and a value of the corresponding item with each of the speaker characteristics of said speech request recorded in said speech characteristic recording portion; for determining the value of the item without the speaker characteristics condition corresponding to the calculated result; for designating speaker characteristics corresponding to a predetermined method with reference to the speaker characteristics stored in said synthesizer characteristic storing portion; and for issuing a command representing the designated speaker characteristics to said speech synthesizing portion.

8. The speech synthesizing apparatus as set forth in claim 7, further comprising:

means wherein said speech synthesizing portion is connected to a speech element generating portion for varying speaker characteristics corresponding to a speech request and a sound reproducing device for outputting the synthesized speech with the speaker characteristics selected in according with the speech request.

9. The speech synthesizing apparatus as set forth in claim 7, wherein said synthesizer characteristics storing portion stores values of predetermined items as a synthesizer characteristic table for determining conditions of the synthesizer characteristic table corresponding to the calculated value of said speaker difference recognizability parameter calculating portion, and for outputting the condition of said speech synthesizing portion.

10. The speech synthesizing apparatus as set forth in claim 7, wherein a cumulated difference of which the speaker difference recognizability parameter is cumulated for each speech request recorded in said speaker characteristics recording portion is obtained, and wherein an alarm is issued or a speech is not synthesized when the minimum cumulated difference is smaller than a predetermined threshold value.

11. A method of synthesizing speech comprising of steps of:

a. storing a plurality of speaker characteristics on recording tables;

b. controlling speaker characteristics recognition responsive to a list of default speaker characteristics obtained from said recording table;

c. dynamically enhancing speaker characteristics recognition by changing a partial list of the speaker characteristics recorded on said recording table; and d. further enhancing speaker characteristics recognition by changing a background portion of said speaker characteristics prior to changing selected values of the speaker characteristics in step c.

12. The method of claim 11 further comprising the steps of:

e. recording a set of speaker characteristics for each speech synthesis request;

f. calculating a speaker difference recognizeablity parameter responsive to a difference of synthetic speech;

g. step (f) comprising a first calculation of speaker difference recognizability parameters between two synthetic speakers by calculating a speaker difference recognizeabilty parameter dependent on the change of speaker characteristics obtained in step d; and h. a second calculation of larger speaker difference recognizability parameter which is performed by changing the calculation of step g to another state before invoking the controlled changing of the speaker characteristics.

* * * * *